United States Patent [19]

Argento et al.

[11] 4,055,853

[45] Nov. 1, 1977

[54] CONVERTIBLE COAT AND TOTE BAG

[76] Inventors: Gloria Argento, 14718 Cranbrook, Hawthorne, Calif. 90250; Margaret Strandt, 14835 Dublin Ave., Gardena, Calif. 90249

[21] Appl. No.: 762,114

[22] Filed: Jan. 24, 1977

[51] Int. Cl.[2] ..... A41D 3/02

[52] U.S. Cl. ..... 2/93; 2/247

[58] Field of Search ..... 2/93, 86, 89, 94, 247, 2/DIG. 6, 251, 252, 254, 69, 69.5; 150/35, 34, 28 R

[56] References Cited

U.S. PATENT DOCUMENTS

| | | | |
|---|---|---|---|
| 2,292,347 | 8/1942 | Bailey | 2/93 |
| 2,825,902 | 3/1958 | Breier | 2/93 |
| 2,959,789 | 11/1960 | Mills et al. | 2/93 |
| 3,085,254 | 4/1963 | Cutler | 2/247 |

FOREIGN PATENT DOCUMENTS

| | | | |
|---|---|---|---|
| 1,054,482 | 2/1954 | France | 2/93 |
| 61,921 | 1/1940 | Norway | 2/94 |
| 42,037 | 11/1907 | Switzerland | 2/93 |

*Primary Examiner*—Werner H. Schroeder
*Assistant Examiner*—Moshe I. Cohen
*Attorney, Agent, or Firm*—Singer & Singer

[57] ABSTRACT

This invention describes apparatus and method for constructing an outer garment capable of being converted to a tote bag. The coat comprises a full belt forming an upper half and a lower half. The lower half has a pair of deep pockets having zippered openings on the uppermost portion only. The upper half also contains a pair of deep pockets having zippered openings on both the uppermost portion and the lowermost portion. Snap hooks located on the back of the collar and the back portion of the coat in the area of the belt are adapted to snap together thereby defining an equal upper and lower half. The coat is folded about the belt portion and hooks located on the outermost portion of the deep pockets are connected together thereby exposing the upper deep pockets on one side of the belt and the lower deep pockets on the other side of the belt. The belt is adjustable allowing the user to wear the tote bag over a shoulder or to hold the belt as a conventional bag.

8 Claims, 9 Drawing Figures

CONVERTIBLE COAT AND TOTE BAG

This invention relates to a convertible garment and specifically to an outer garment capable of being worn as a jacket and which is adaptable to be converted into a tote bag as designed by the user.

This invention is concerned with providing a wearer with a fashionable outer garment that has the capability of being used functionally as a tote bag.

A review of the prior art concerning convertible garments shows that the art has developed primarily in the area of rain garments that are specifically designed to fold into small areas, either into specialized pockets for ease of carrying, or to fold within a pocket of the garment itself or possibly into a preconstructed opening in the collar area of the garment.

These prior art convertible garments do not change their function into a different kind of garment but rather are simply refolded for ease of carrying and usually in a much smaller space or area.

The prior art also discloses convertible garments of the type that are turned inside out in which different colors or different kinds of material are placed on the outside and the lining to thereby allow the user to use the garment with a different outside covering to he elements. These prior art garments preserve the garment in their original configuration and simply consist of turning the garment inside out with buttons or belts suitably located to accomplish the change.

The present disclosure is concerned with an outer garment that is stylish and capable of being worn as a conventional outer garment without any indicia or evidence that the garment is capable of being converted into a tote bag. When the garment is converted into a tote bag in accordance with the teachings of this invention, the tote bag has no relationship to an outer garment and will appear to the trained and untrained observer to be a tote bag having large deep pockets on one side of a handle and large deep pockets on the other side of a handle for accepting indicia usually carried by persons having a tote bag. The user may fill the pockets on either side in a conventional manner and still have these pockets available for access when the tote bag is again converted to an outer garment and worn by the user.

The invention is concerned primarily with an outer garment having an adjustable belt for completely encircling the garment.

The style of the garment is not critical to the invention and it is presumed that the garment may either have long sleeves or short sleeves, a full collar or small collar, or a collar of any size determined only by the mores of the times. The front portion of the garment below the belt contains a pair of deep pockets having zippered openings on the uppermost portion. The front portion of the garment above the belt also contains a pair of deep pockets each having zippered portions on both the uppermost portion and the lowermost portion.

The collar contains a pair of snaps adapted to be connected to a pair of snaps located on the back of the garment in the area covered by the belt. The snaps are located to define an equal portion of the garment below the belt and above the belt when the collar portion is snapped in place to the back portion of the garment. The sleeves are suitably folded in behind the collar thereby keeping the sleeves in place. The garment is folded about the belt around the back thereby exposing the upper deep pockets on one side of the belt and the lower deep pockets on the other side of the belt.

Hooks located on the longitudinal outside edge of both the lower pockets and the upper are connected together to form the basic tote bag. The garment is gathered about the belt and the belt adjusted to be used either as a strap around the shoulder or as a handle to be hand held.

The user therefore has access to both the upper pockets by using the lowermost zippered openings and the bottom pockets by using the uppermost zippered openings. To all outward appearances the tote bag appears to be a conventional tote bag with no evidence to the casual observer that the tote bag is anything but a tote bag.

Further objects and advantages of the invention will be made more apparent by referring now to the accompanying drawings wherein.

Figure 1:
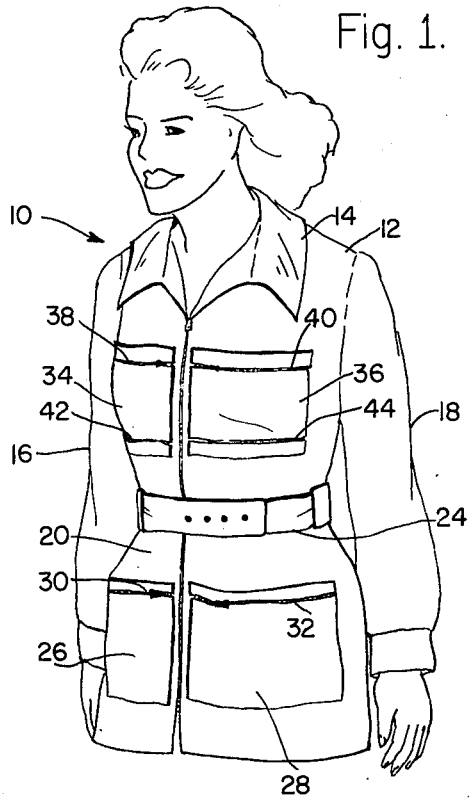
FIG. 1 illustrates the garment being worn by the user as a conventional outer jacket.

Referring now to FIG. 1, there is shown a model 10 wearing an outer garment 12 constructed according to the teachings of this invention.

Figure 4:
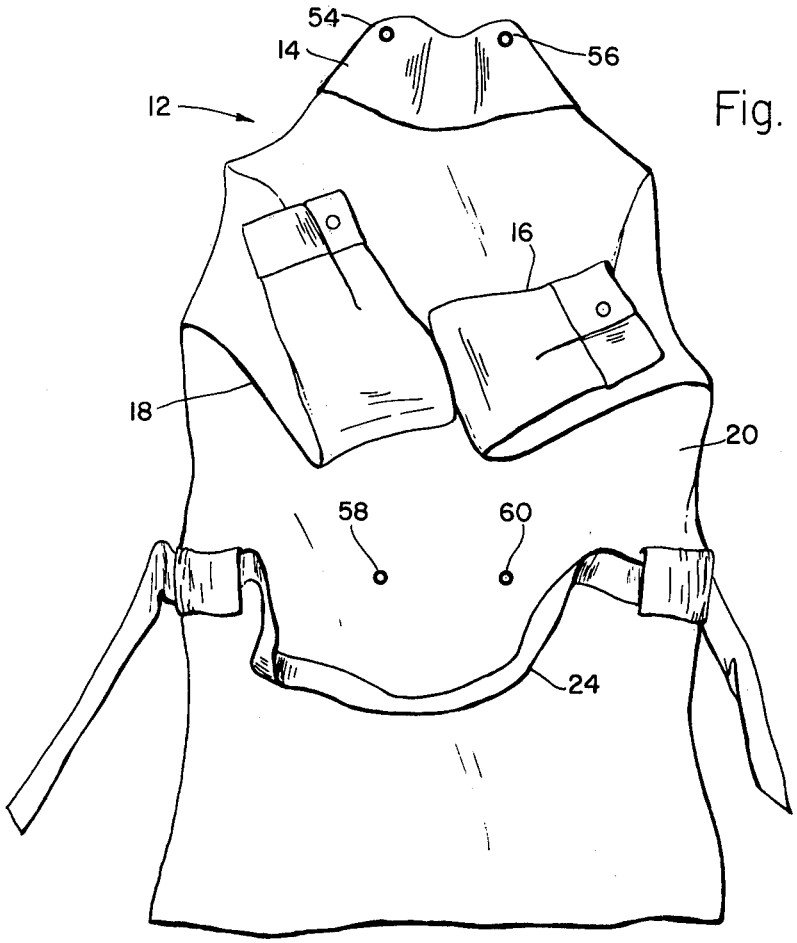
FIG. 4 illustrates the rear view of the garment with the sleeves folded.

The outer garment 12 is constructed in the form of a jacket having a collar 14, long sleeves 16 and 18, a front portion 20, a rear portion 22 more fully illustrated in FIG. 4, and a belt 24.

The actual style of the garment 12 is not critical to the invention since it is envisioned that the sleeves 16 and 18 may be short sleeves or mid-length or any other length determined only by the designer. Similarly the length of the jacket may be longer or shorter and the collar 14 may be deep, long, short, or even have no collar at all. The designer will therefore have wide latitude in presenting a convertible outer garment according to the teachings of this invention.

The critical portion of the invention concerns a pair of deep pockets 26 and 28 located on the front member 20 and below the belt 24. Deep pockets 26 and 28 have operable access ports 30 and 32 located only on the uppermost portion of the deep pockets respectively. In the preferred embodiment, ports 30 and 32 may consist of zippers or any other type of closure devices considered stylish by the designer.

Located on the front member 20 and above the belt 24 is a second pair of deep pockets 34 and 36. Deep pockets 34 and 36 each contain operable access ports on the uppermost portion 38 and 40 respectively, and ports 42 and 44 on the lowermost portion of the pockets 34 and 36 respectively. In the preferred embodiment ports 38, 40, 44 may be conventional zippers or any other kind of closure devices desired by the designer. It is critical to the practice of the invention that upper pockets 34 and 36 contain closure ports on both the uppermost portion and the lowermost portion.

The convertibility of the outer garment 12 is predicated on the garment eventually being folded about the belt so as to expose the upper pockets 34 and 36 on one side of the belt and lower pockets 26 and 28 on the lower side of the belt and for this reason closure ports 42 and 44 on the upper pockets are necessary since in the folded position as a tote bag, ports 42 and 44 will be near the belt and in the uppermost portion closest to the user.

Figure 2:
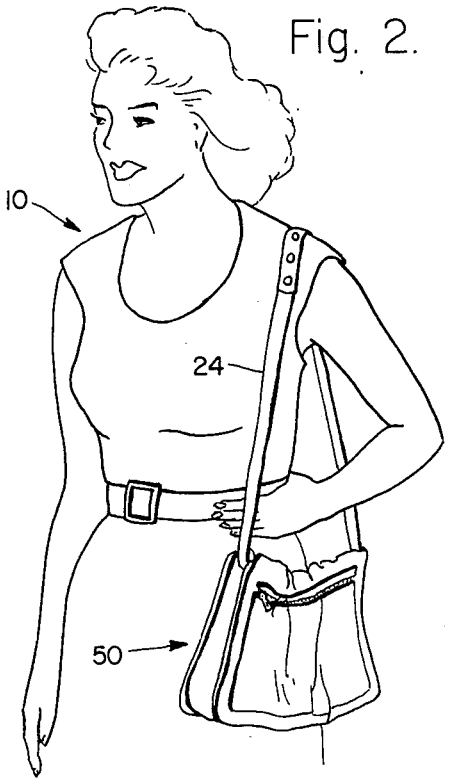
FIG. 2 illustrates the garment being worn by the user as a tote bag.

Referring now to FIG. 2, there is shown a model 10 wearing the convertible garment as a tote bag. The strap of the tote bag is actually adjustable strap 24 placed in the longest position to be worn over the shoulder of the user.

Figure 3:
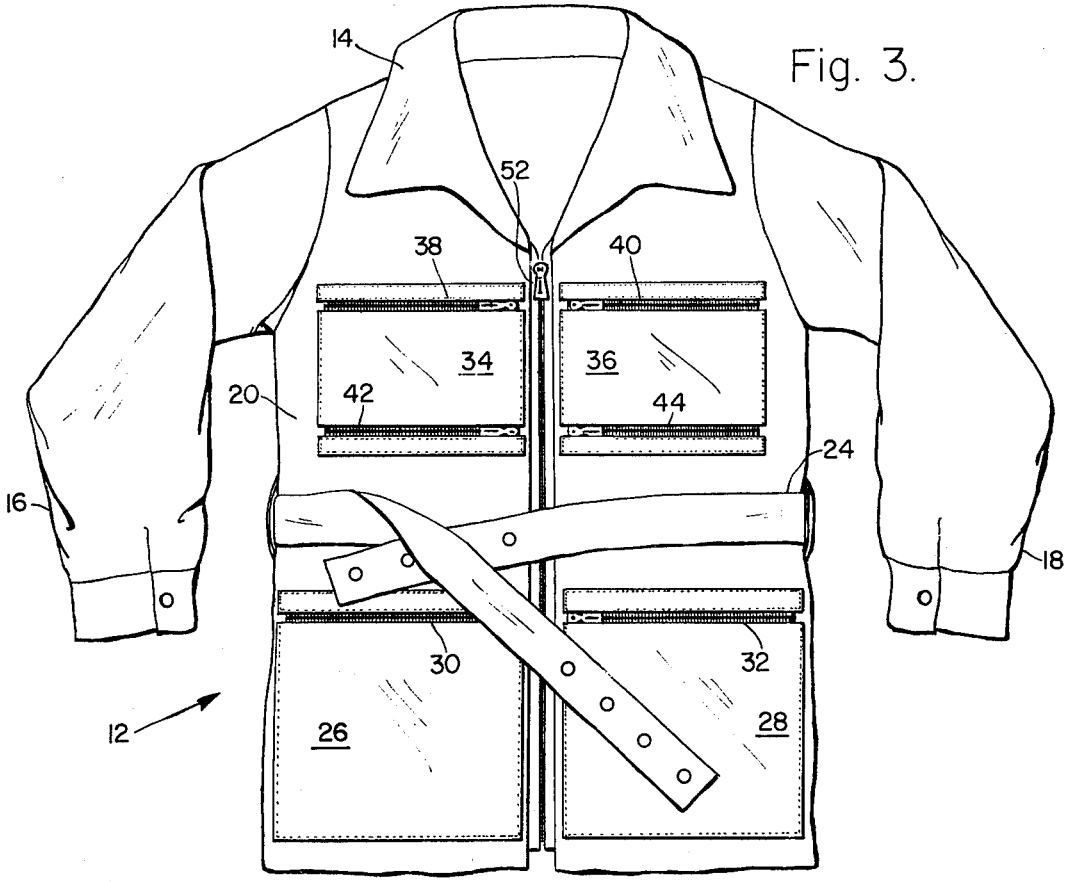
FIG. 3 illustrates the front view of the garment as an outer garment prior to conversion.

Referring now to FIG. 3, there is shown a front view of the outer garment 12 preparatory to be folded and converted into a tote bag 50. The outer garment 12 illustrated in FIG. 3 is shown having a centrally located zipper 52. The outer garment 12 may have any kind of closure means, be it a zipper, buttons or velcro fastening device. It is required in the practice of the invention that a closure means sufficient to hold the front member portion in a closed position be provided.

In the practice of the invention all closure means associated with the outer garment 12 are zippered shut. For example, zipper 52 is closed as well as zippers 38 and 42 associated with pocket 34, zippers 40 and 44 associated with pocket 36, zipper 30 associated with pocket 26, and zipper 32 associated with pocket 28.

Referring now to FIG. 4, there is shown a back view of the outer garment 12 more fully illustrating the rear portion 22. Sleeves 16 and 18 are folded and placed against the rear member 22.

Located on the back of collar 14 is a pair of snaps 54 and 56. Located in the central portion on the rear member 22 is a pair of cooperating snaps 58 and 60. Snaps 58 and 60 are placed in an area on the rear member 22 that is substantially covered by the belt 24 when located in the conventional position. FIG. 4 illustrates how belt 24 is moved to expose snaps 58 and 60.

Figure 5:
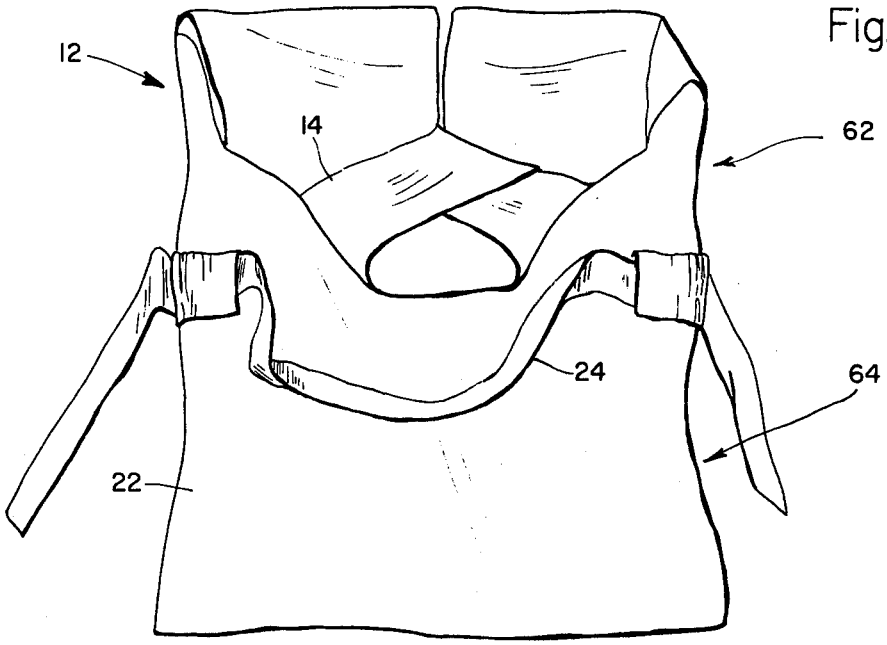
FIG. 5 illustrates the rear view of the garment with the collar connected to the snaps located on the back of the garment.

Referring now to FIG. 5, there is shown the outer garment 12 folded about the rear member 22 in such a manner that snaps 54 and 56 on the back of a collar 14 are engaged respectively with snaps 58 and 60 located on the back of the rear member.

A review of FIG. 5 will show that the upper portion of the garment 62 measured from the belt 24 and the lower portion of the garment 64 also measured from the belt 24 is substantially equal.

It is important in the practice of the invention that the upper portion 62 and the lower portion 64 be substantially equal since the upper portion 62 is then folded over the belt 24 to thereby form the basis for the tote bag 50.

Figure 6:
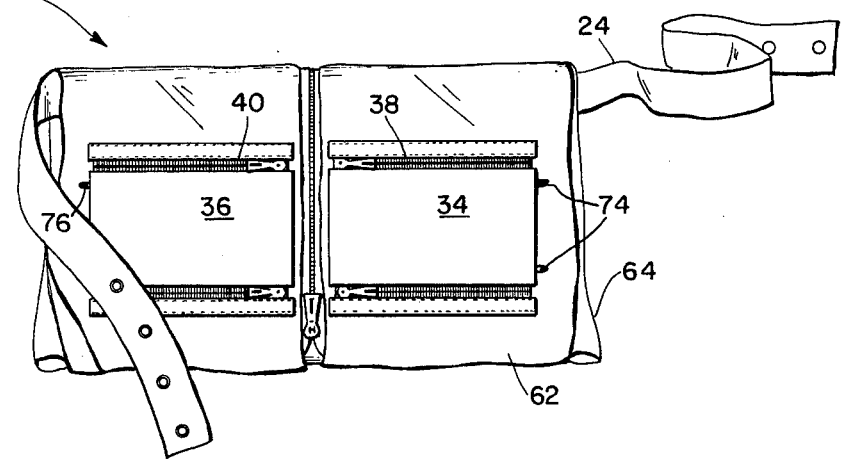
FIG. 6 illustrates the garment folded about the belt and exposing the upper deep pockets located on the front of the garment.

Referring now to FIG. 6, there is illustrated the very next step where the upper portion 62 is folded over the belt 24 thereby exposing pockets 36 and 34 located on the upper portion of the front member 20.

Figure 7:
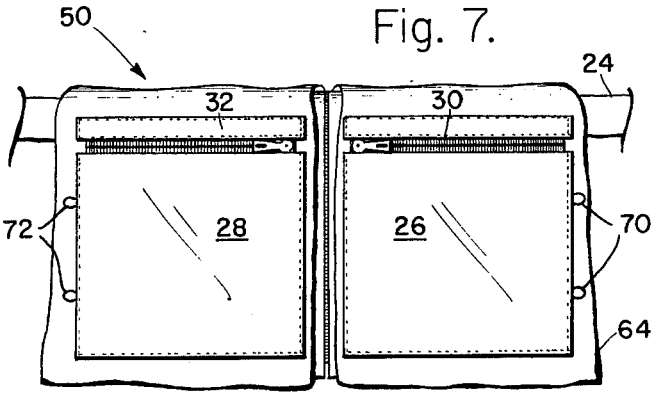
FIG. 7 illustrates the garment folded about the belt and illustrating the lower deep pockets located on the front of the garment.

Referring now to FIG. 7, there is shown the reverse side of the tote bag 50 illustrating deep pockets 28 and 26 located on the bottom portion of the front member 20.

A review of FIGS. 6 and 7 will show that the tote bag 50 allows the user access to deep pocket 34 and 36 located on one side through zippers 38 and 40 respectively. Deep pockets 26 and 28 are similarly available to the user on the other side through zippers 30 and 32 respectively.

The tote bag is completed by means of interlocking hooks 70 and 72 located on the vertical outside panel of deep pockets 26 and 28 respectively with hooks 74 and 76 located on the vertical outside panel of pockets 34 and 36 respectively.

Figure 8:
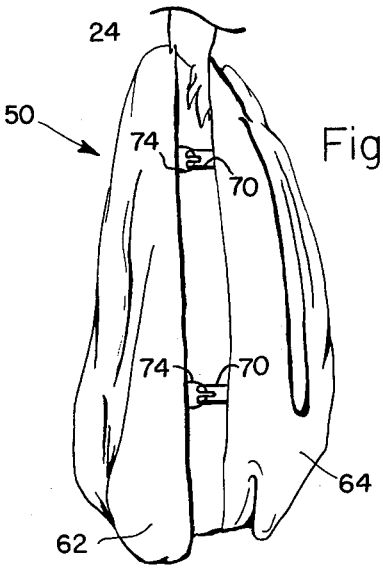
FIG. 8 illustrates a side view showing the hooks located on the longitudinal edge of the deep pockets connected together to form the tote bag.

Referring now to FIG. 8, there is shown a side view of the tote bag 50 showing how the hook 74 located on pocket 34 is interconnected with hook 70 located on the side panel of pocket 26.

Figure 9:
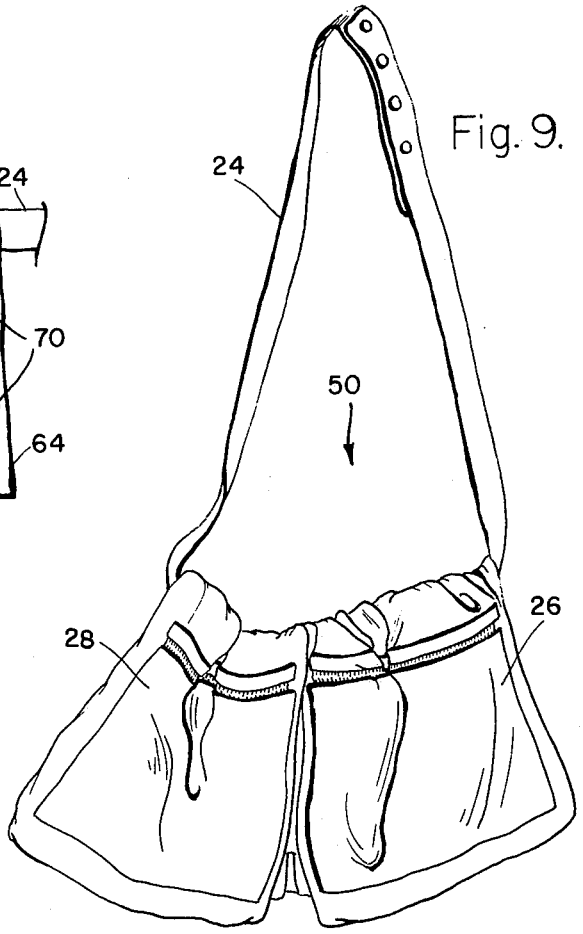
FIG. 9 illustrates the converted tote bag to be worn by the user.

Referring now to FIG. 9, there is shown the finished tote bag 50 with the adjustable belt 24 extended to the longest position to be used as an over the shoulder tote bag. The tote bag itself is fluffed up formed over the belt 24 thereby exposing deep pockets 28 and 26 on the side illustrated.

We claim:

1. A garment convertible from an outer coat to a tote bag comprising:

an outer garment having at least a front portion, a collar portion and a back portion, a belt completely encircling said front portion and said back portion thereby defining an upper portion and a lower portion, a first pair of deep pockets having access ports on the uppermost portion and located on the front lower portion of the jacket, a second pair of deep pockets having access ports on both the uppermost portion and the lowermost portion and located on the front upper portion of said garment, locking snaps located on said collar portion and the central portion of said back portion for holding said collar portion close to the back portion when folded, and hooks located on the longitudinal outside edges of said first pair of pockets and said second pair of pockets and adapted to be interconnected when said upper portion and said lower portion are folded about said belt thereby forming a tote bag with the belt as the handle or strap and said first pair of pockets located on one side of the strap and said second pair of pockets located on the other side of said strap.

2. A garment according to claim 1 in which the locking snaps located on said collar and the locking snaps located on said back portion are positioned to define an equal upper and lower portion when said locking snaps are attached to each other.

3. A garment according to claim 1 in which said locking snaps located on the back central portion are in an area covered by said belt when located in the preferred position and used as an outer garment.

4. A garment according to claim 1 in which said front portion is completely separated in two halves by means of a zipper extending longitudinally of the garment adapted to interconnect both halves of said front portion.

5. A garment according to claim 1 in which said first pair of deep pockets each contain a zipper located laterally in the uppermost portion and the lowermost portion of said pair of pockets.

6. A garment according to claim 1 in which said second pair of deep pockets each contain a zipper located laterally on the uppermost portion of each pocket.

7. A garment according to claim 1 in which said belt is adjustable for the complete length of the belt to thereby allow the belt to be used as a shoulder strap or as a hand strap when converting the garment to a tote bag.

8. A method of converting an outer garment having a front portion, a pair of sleeves, a collar portion, and a back portion and a belt completely encircling said front portion and said back portion thereby defining an upper portion and a lower portion to a tote bag comprising the steps of:

locating a pair of deep pockets on the front member of the garment above the beltline and a pair of deep pockets on the front portion of the garment below the beltline, folding the upper portion of the garment including the collar and sleeves towards the back and locking the collar portion against the back portion with the sleeves within the folded, locked portion by suitable snaps thereby creating an upper portion above the belt equal in length to the lower portion below the belt, then folding the upper portion around the belt towards the back so as to expose the upper deep pockets on the other side, then locking the end portions of the folded members together on each side and gathering the material about the belt to form a tote bag with access to a pair of deep pockets on each side.

* * * * *